US007305804B2

(12) United States Patent
Frabetti et al.

(10) Patent No.: US 7,305,804 B2
(45) Date of Patent: Dec. 11, 2007

(54) OUTLET DEVICE FOR CHOCOLATES AND THE LIKE

(75) Inventors: Fabio Frabetti, Bologna (IT); Luca Baraldi, Bologna (IT); Giovanni Bergami, Toscanella Di Dozza (IT)

(73) Assignee: SACMI Packaging S.p.A., Imoia (IT)

( * ) Notice: Subject to any disclaimer, the term of this patent is extended or adjusted under 35 U.S.C. 154(b) by 0 days.

(21) Appl. No.: 10/573,102

(22) PCT Filed: Sep. 23, 2004

(86) PCT No.: PCT/IB2004/003097

§ 371 (c)(1),
(2), (4) Date: Mar. 23, 2006

(87) PCT Pub. No.: WO2005/030589

PCT Pub. Date: Jul. 4, 2005

(65) Prior Publication Data

US 2007/0017183 A1 Jan. 25, 2007

(30) Foreign Application Priority Data

Sep. 25, 2003 (IT) ..... BO2003A0554

(51) Int. Cl.
*B65G 25/02* (2006.01)
*B65B 11/18* (2006.01)

(52) U.S. Cl. ..... 53/375.4; 53/203; 53/216; 198/626.1; 198/603

(58) Field of Classification Search ..... 198/626.1, 198/717, 725, 603; 53/375.4, 203, 216
See application file for complete search history.

(56) References Cited

U.S. PATENT DOCUMENTS

| | | | | |
|---|---|---|---|---|
| 4,431,678 | A * | 2/1984 | Sollich | 426/306 |
| 4,587,794 | A * | 5/1986 | Kopp | 53/550 |
| 5,792,488 | A * | 8/1998 | Giuliano | 425/439 |
| 6,516,995 | B2 * | 2/2003 | Spatafora | 229/87.08 |
| 6,732,498 | B2 * | 5/2004 | Keen et al. | 198/471.1 |
| 6,907,978 | B2 * | 6/2005 | Evans et al. | 198/370.09 |
| 2002/0022098 | A1 * | 2/2002 | Spatafora | 428/35.3 |

FOREIGN PATENT DOCUMENTS

| | | |
|---|---|---|
| DE | 423693 | 10/1926 |
| EP | 773162 | * 5/1997 |

* cited by examiner

*Primary Examiner*—Rinaldi I. Rada
*Assistant Examiner*—Gloria R. Weeks
(74) *Attorney, Agent, or Firm*—William J. Sapone; Coleman Sudol Sapone P.C.

(57) ABSTRACT

An outlet device for chocolates and like products (100) for use with a wrapping machine (50) which has a device (51) for moving each product (100). The outlet device has a first belt (2) for moving products (100) to be rolled, which is operated by an actuator (10), through a first connecting device (5), which connects the first belt (2) to the actuator (10), moving the first belt in a first direction (A) in accordance with the rotary motion of the actuator (10). A rolling device (4) faces the first belt (2) and is used for rolling products (100) moved by the first belt. A second belt (3) moves products (100) which do not require rolling, the second belt also operated by the actuator (10), through a second connecting device (6), the second belt rotated in a second direction (B) also in accordance with rotation of the actuator (10).

12 Claims, 3 Drawing Sheets

OUTLET DEVICE FOR CHOCOLATES AND THE LIKE

TECHNICAL FIELD

The present invention relates to technical field of automatic packaging machines, and particularly the invention relates to an outlet device for chocolates or the like for a wrapping machine.

BACKGROUND ART

In the known wrapping machines, the outlet device provides to carry the products, either partially or completely wrapped, from the folding stations to the outlet area, for in-line connection to a subsequent packaging machine or collection within suitable containers. In the case of products having the shape of a solid of revolution, such as small eggs or spheres, depending on the type of wrap to be manufactured, for example "rolled design", with single-, double-end fantail twist, a specific outlet unit is required to be assembled on the wrapping machine respectively capable of carrying the products to the outlet in an ordinate manner while rolling them to complete the wrap thereof with a fancy design, and moving them simply to the outlet according to the so-called "in bulk" mode.

The drawback with these known wrapping machines is that the assembly of the suitable outlet device for manufacturing a particular wrap type is complicated, and this entails both an increase in the machine downtime and the interruption of the production process, as well as having to resort to skilled labour required to carry out these expensive operations.

Packaging machines are known in which two separate and different outlet devices are provided, which are located in two different positions and operated separately, based on the type of wrap of the product. Due to the simultaneous presence of both devices, the outlet device does not require to be replaced each time the type of wrap is changed, however separate motors are required, with a consequent larger machine size, more complicated construction and hence an increase in the machine total costs.

DISCLOSURE OF THE INVENTION

An object of the present invention is to provide an outlet device being capable of moving the products and providing both an outlet of the so-called "in bulk" type, and an outlet with design rolling, requiring only minimum, quick and easy adjustments.

Another object is to provide an outlet device capable of operating at high speed with reliable and regular operation, and which is compact and small-sized.

The above objects are achieved in accordance with the claims.

BRIEF DESCRIPTION OF THE DRAWINGS

The characteristics of the present invention are set forth below particularly with reference to the annexed drawings, in which.

BEST MODE OF CARRYING OUT THE INVENTION

Figure 1:
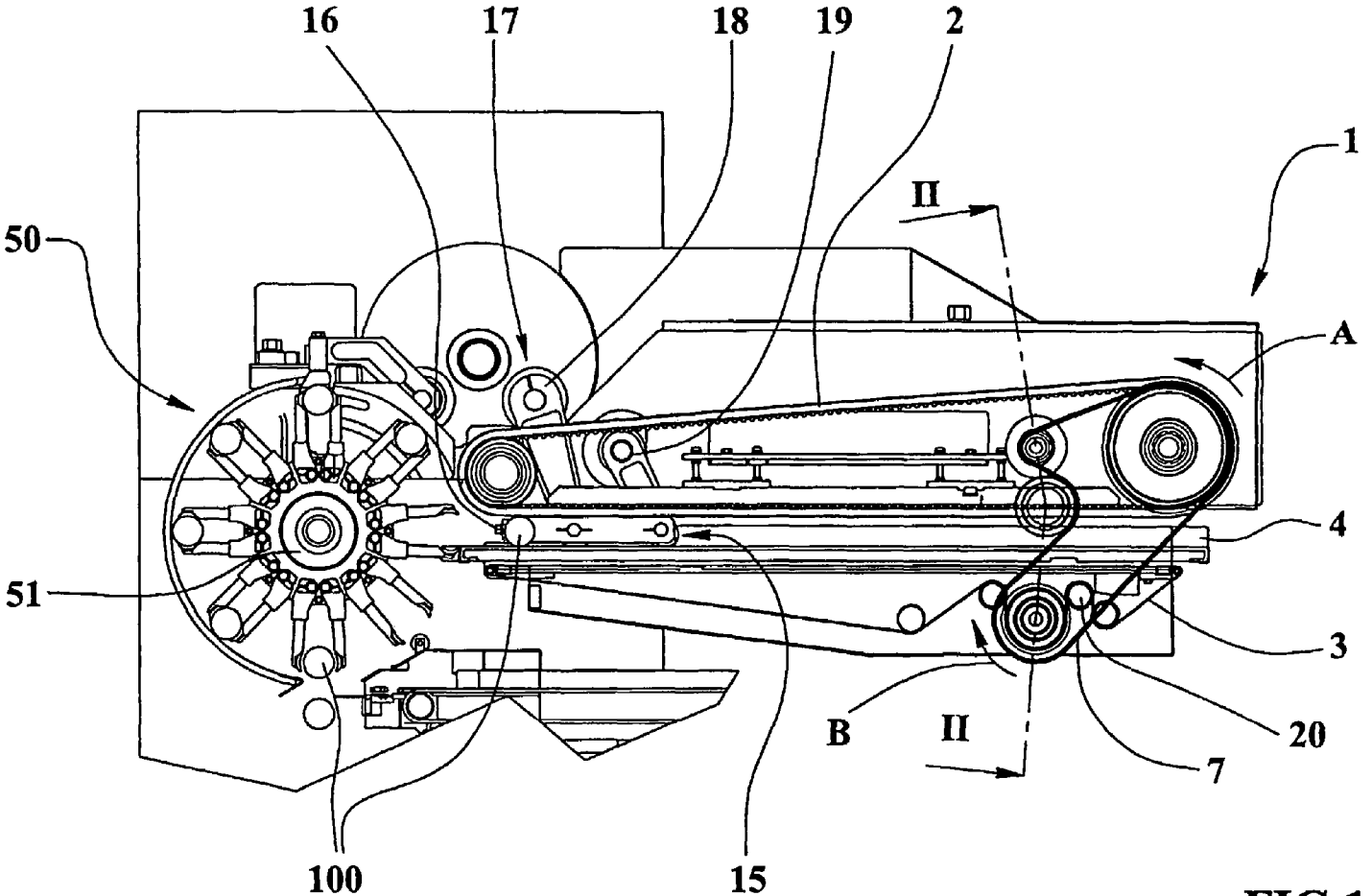
FIG. 1 shows a front view of the outlet device being the object of the present invention when associated to moving means of a wrapping machine.
Figure 2:
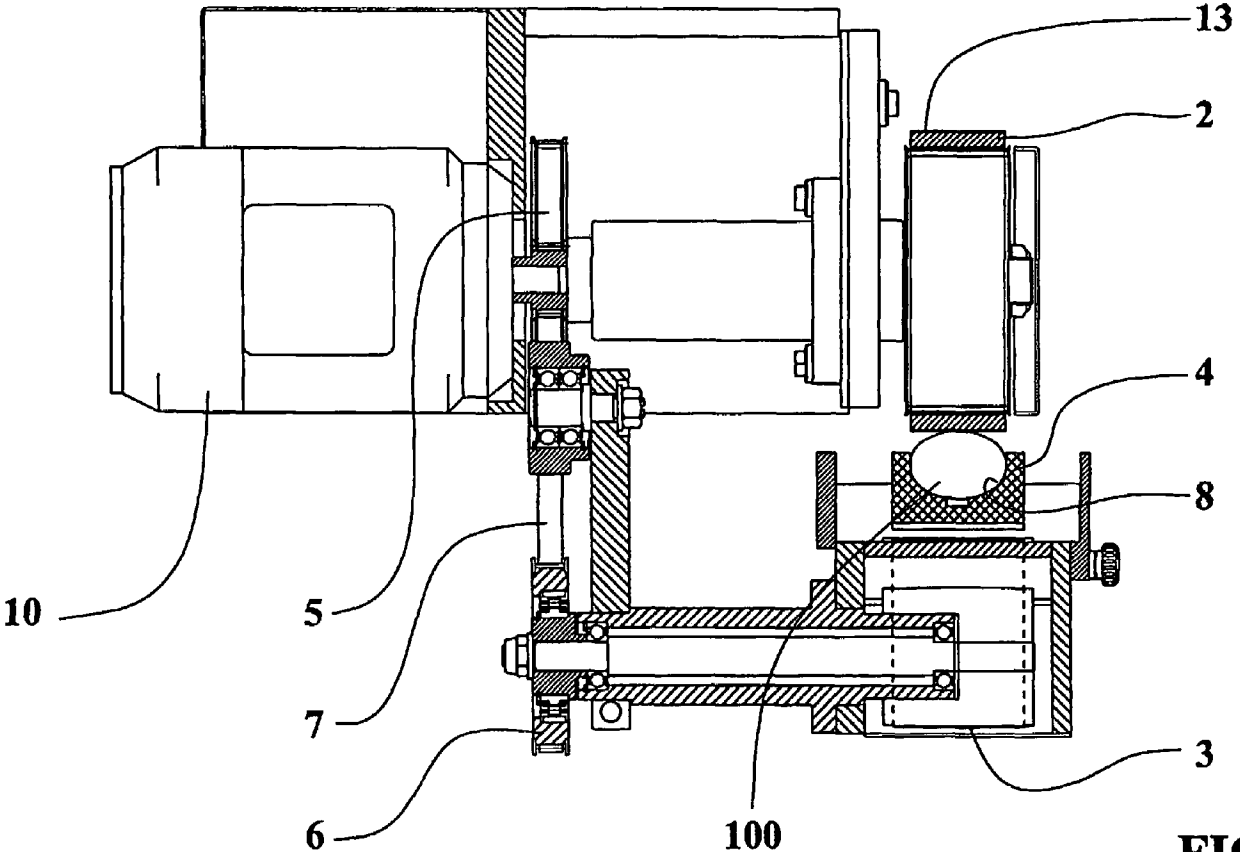
FIG. 2 shows a sectional view of the device taken along the line II-II from FIG. 1.
Figure 3:
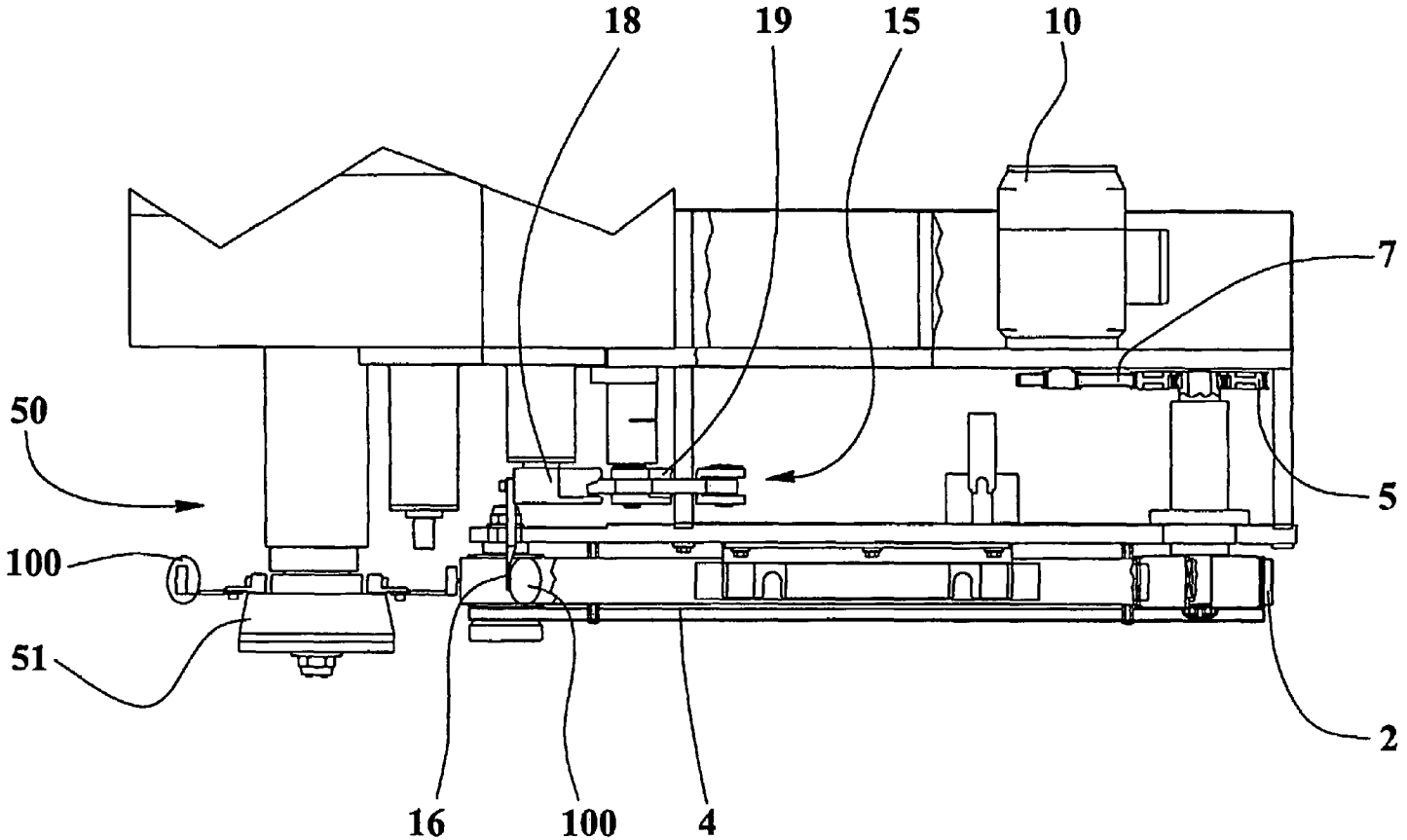
FIG. 3 shows a plan partial view of the device from FIG. 1.

With reference to the FIG. 1 to 3, with 1 there is indicated an outlet device for chocolates and the like 100, for a wrapping machine 50 being provided with moving means 51 for each product 100 through a plurality of wrap folding stations.

The device 1 substantially comprises first 2 and second 3 belt means, which are driven by actuating means 10 through first 5 and second 6 connecting means, respectively, to carry the products 100 being taken from the moving means 51 by means of extraction means 15.

According to a first direction A of the rotary motion of the actuating means 10 the first connecting means 5 connect said actuating means 10 to the first belt means 2, which are then capable to move the products 100 along rolling means 4, such as to carry out a wrap of said products 100 according to a so-called "rolled design" shape.

According to the second direction B of rotation of the actuating means 10, the second belt means 3 connect said actuating means 10 to the second belt means 3 moving the products 100 which do not require to be rolled according to a so-called "in bulk" mode. The first 2 and second 3 belt means are placed one above the other and the rolling means 4 are detachably interposed therebetween.

The rolling means 4 essentially consist of a prismatic guide provided with an elongated concave housing 8 complementary shaped relative to the products 100 where the product 100 are rolled thereto from the first belt means 2 for the rolling to be carried out thereon. The shape of the concave housing 8 is related to the shape and size of the product 100 to be wrapped.

The position of the rolling means 4 can be adjusted and they can be easily dismounted for quick replacement.

The first belt means 2 preferably consist of a endless timing belt being coated on the outside with a layer of elastic material 13, which abuts and conforms to the surface of product 100 without causing damage thereto.

The second belt means 3 consist of one or several endless flat belts set to the proper tensioning level by adjustment through idler rolls 20.

The first 5 and second 6 connecting means are connected to the actuating means 10, consisting of an electric motor through driving means 7 consisting of a closed loop flexible element or a gear chain.

The first 5 and second 6 connecting means comprise respective idle wheels of the known type, gripping in the first A and second B directions of rotation of the actuating means, respectively, to impart the motion to the respective first 2 and second 3 belt means.

Alternatively, the connecting means 5, 6 can be of the electromagnetic type, operated by the supplying means of the actuating means 10 and electrically/electronically controlled in order to impart or not the rotary motion to the corresponding belt means 2, 3.

The extraction means 15 substantially comprise a pusher 16 being provided with a shaped housing for the product 100 and operated by operating means 17, which provides to take each single product 100 from the moving means 51 and carry it to the first 2 or second 3 belt means.

The operating means 17 consist, in the preferred embodiment, of a couple of levers 18, 19, one of which being motor-driven, which are connected to the pusher 16 to form a articulated quadrilateral. The oscillation set on one of the levers defines the reciprocating movement parallel to the belt means 2, 3 of pusher 16.

There are provided electronic calculation and control means being generally integrated to those in the wrapping machine to which the device is assembled, which are suitable to control the phase relationship of the extraction means 15 to the moving means 51.

The operation of the outlet device 1 for chocolates and the like 100 provides the separate and alternate operation of the first 2 and second 3 belt means by selecting the direction of rotation of the actuating means 10.

The rotation of the actuating means 10 according to a first direction A, for example counter-clockwise such as illustrated in FIG. 1, defines the insertion of the first connecting means 5 and the removal of the second connecting means 6. In the particular case, the idle wheel of the first connecting means 5 imparts the motion to the first belt means 2, while the idle wheel of the second connecting means 6 turns "idle" thus leaving the second belt means 3 stationary. Thereby, the products 100 to be rolled, being taken through the extraction means 15 from the moving means 51 of the wrapping machine 50, can be moved along the elongated concave housing 8 of the rolling means 4, in order to carry out a wrap with a so-called "rolled design" shape.

On the contrary, a rotation of the actuating means 10 in the opposite direction B, defines the insertion of the second driving means 6 and the removal of the first driving means 5, consequently operating the second belt means 3 and holding the first belt means 2 in the stationary position. In this case, after the rolling means 4 have been removed, the second belt means 3 are capable to carry the products 100 not to be rolled, in a so-called "in bulk" mode.

It is important to notice how the use of connecting means 5, 6 enables to operate both belt means 2, 3 separately by using the same actuating means 10 in opposite rotary directions.

The main advantage of the present invention is to provide an outlet device being capable of moving the products thus providing both an outlet of the so-called "in bulk" type, and an outlet for wraps of the "rolled design" type, requiring only minimum, quick and easy adjustments.

Another object is to provide an outlet device being capable of operating at high speed with reliable and regular operation, and which is compact and small-sized.

The invention claimed is:

1. Outlet device for chocolates and the like (100) for a wrapping machine (50), said device (1) comprising: at least one moving means (51) for moving products (100); first belt means (2) for moving the products (100) to be rolled; second belt means (3) for moving products that do not require being rolled; actuating means (10) for actuating the first belt means and the second belt means; first connecting means (5) for connecting the first belt means (2) to the actuating means (10), according to a first direction (A) of a rotary motion by said actuating means (10); second connecting means (6) connecting the second belt means according to a second direction (B) of rotary motion by said actuating means (10); and, rolling means (4) facing the first belt means for rolling the products (100) being moved by the first belt means (2), wherein the rolling means are detachable and interposed between the first (2) and second (3) belt means; the rolling means (4) having an elongated concave housing (8), complementary shaped relative to the products (100) being moved by the first belt means (2).

2. Device according to claim 1 characterized in that the first (5) and second (6) connecting means each respectively have idle wheels for gripping in the first (A) and second (B) direction of rotation of the actuating means (10).

3. Device according to claim 1 characterized in that the first (5) and second (6) connecting means are of the electromagnetic type and are operated by supplying means of the actuating means (10).

4. Device according to claim 1 characterized in that the first (5) and second (6) connecting means are connected to actuating means (10) through driving means (7).

5. Device according to claim 4 characterized in that the driving means (7) comprise a closed loop flexible element or a gear chain.

6. Device according to claim 1 characterized in that it comprises extraction means (15) for taking a single product (100) from the moving means (51) and carrying it to the belt means (2, 3).

7. Device according to claim 6 characterized in that the extraction means (15) comprise a pusher (16) being provided with a shaped housing for the product (100) and operated by operating means (17).

8. Device according to claim 7 characterized in that the operating means (17) comprise a couple of levers (18, 19), at least one of which being motor-driven, connected to the pusher (16) to form an articulated quadrilateral.

9. Device according to claim 1 characterized in that the actuating means (10) consist of an electric motor.

10. Device according to claim 1 characterized in that the first belt means (2) comprise at least one endless timing belt, which is coated on the outside relative to the teeth with a layer of elastic material (13).

11. Device according to claim 1 characterized in that the second belt means (3) comprise at least one endless belt.

12. Device according to any preceding claim characterized in that it further comprises calculation and control means to control a phase relationship between at least the extraction means (15) and the moving means (51).

* * * * *